US008567928B2

(12) United States Patent
Kotabe et al.

(10) Patent No.: US 8,567,928 B2
(45) Date of Patent: Oct. 29, 2013

(54) INK DRIVEN SOLVENT PUMP FOR AN IMAGE FORMING APPARATUS

(75) Inventors: Hiroshi Kotabe, Hitachi (JP); Toshihide Nagamine, Toukai (JP); Akira Miyao, Hitachi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 138 days.

(21) Appl. No.: 12/365,997

(22) Filed: Feb. 5, 2009

(65) Prior Publication Data

US 2010/0066790 A1 Mar. 18, 2010

(30) Foreign Application Priority Data

Sep. 17, 2008 (JP) ..... 2008-238182

(51) Int. Cl.

| | |
|---|---|
| ***B41J 2/175*** | (2006.01) |
| *B41J 2/165* | (2006.01) |
| *B41J 2/02* | (2006.01) |
| *B41J 2/17* | (2006.01) |

(52) U.S. Cl.

USPC ..... 347/85; 347/22; 347/73; 347/84

(58) Field of Classification Search

USPC ..... 347/85

See application file for complete search history.

(56) References Cited

U.S. PATENT DOCUMENTS

| | | | | |
|---|---|---|---|---|
| 4,334,838 | A * | 6/1982 | Fessler et al. | 417/395 |
| 4,658,268 | A * | 4/1987 | Needham | 347/7 |
| 4,714,931 | A * | 12/1987 | Erskine et al. | 347/7 |
| 4,827,278 | A * | 5/1989 | Lecheheb | 347/7 |
| 4,864,323 | A * | 9/1989 | Lecheheb et al. | 347/78 |
| 5,418,557 | A * | 5/1995 | Pullen | 347/7 |
| 6,003,965 | A * | 12/1999 | Arway et al. | 347/7 |
| 6,698,869 | B2 * | 3/2004 | Vosahlo | 347/85 |
| 7,475,974 | B2 * | 1/2009 | Matsuda et al. | 347/90 |
| 7,699,455 | B2 * | 4/2010 | Matsuda et al. | 347/90 |
| 8,425,018 | B2 * | 4/2013 | Tomlin et al. | 347/85 |
| 8,439,489 | B2 * | 5/2013 | Tomlin et al. | 347/85 |

(Continued)

FOREIGN PATENT DOCUMENTS

| | | | |
|---|---|---|---|
| EP | 1700700 | A2 | 9/2006 |
| JP | 10-296997 | A | 11/1998 |

(Continued)

OTHER PUBLICATIONS

Videojet 43s Ink Jet Printer Service Manual P/N 361451-21 Revision: AB, Apr. 2003.*

(Continued)

*Primary Examiner* — Laura Martin
*Assistant Examiner* — Jeremy Bishop
(74) *Attorney, Agent, or Firm* — Kilpatrick Townsend & Stockton LLP

(57) ABSTRACT

A configuration of an image display apparatus which can reduce a pump exclusive for solvent is provided. The image display apparatus of the present invention is provided with an ink chamber in an ink supply path from an ink container to a printhead and a solvent chamber in a solvent supply path from a solvent container to the printhead. The ink chamber and the solvent chamber are formed by dividing a liquid chamber by an elastic member (diaphragm), and volumes (capacities) of the ink chamber and the solvent chamber are changed by a pressure of the ink.

8 Claims, 4 Drawing Sheets

(56) References Cited

U.S. PATENT DOCUMENTS

| | | | | |
|---|---|---|---|---|
| 2010/0220128 | A1* | 9/2010 | Zaba et al. | 347/6 |
| 2010/0220159 | A1* | 9/2010 | Tomlin et al. | 347/85 |
| 2010/0238243 | A1* | 9/2010 | Tomlin et al. | 347/93 |

FOREIGN PATENT DOCUMENTS

| | | | |
|---|---|---|---|
| JP | 2007-190725 | | 8/2007 |
| WO | WO97/09176 | A1 | 3/1997 |
| WO | WO00/68018 | A1 | 11/2000 |
| WO | WO 2009047501 | A1 * | 4/2009 |
| WO | WO 2009049135 | A1 * | 4/2009 |
| WO | WO 2009049140 | A1 * | 4/2009 |
| WO | WO 2009049141 | A1 * | 4/2009 |
| WO | WO 2009049146 | A1 * | 4/2009 |

OTHER PUBLICATIONS

European Patent Office Search Report for application EP09001531.4 (Sep. 27, 2010).
Japan Patent Office office action for patent application JP2008-238182 (Mar. 21, 2012).
Videojet 1310 Service Manual P/N361541-01 Rev AD (Nov. 2005).
"Videojet 1310 Ink Jet Printer," New Equipment Digest Online Buyer's Guide (Jun. 2006).
"Videojet simplfies coding operation," In-PharmaTechnologist.com (Jul. 2006).
"Bar Codes Step Up to the Plate," Pharmaceutical & Medical Packaging News, vol. 14, No. 11 (Nov. 2006).
Japan Patent Office office action for patent application JP2008-238182 (May 15, 2012).

* cited by examiner

INK DRIVEN SOLVENT PUMP FOR AN IMAGE FORMING APPARATUS

BACKGROUND OF THE INVENTION (1) Field of the Invention

The present invention relates to an image display apparatus and relates to improvement of the image display apparatus for recording on a target article by injecting ink made into a particle state and by forming an electric field in a travel path of charged ink particles so as to deflect the ink particles, for example.

(2) Description of the Related Art

The image display apparatus has a supply pump for supplying ink from an ink container to a nozzle, a collecting pump for discharging and particulating the ink from the nozzle and collecting it in the ink container as necessary, and moreover, a pump exclusive for solvent, and main usages of the pump exclusive for solvent are replenishment of a solvent in order to avoid increase in concentration in the ink container and nozzle cleaning at the end of ink injection.

As mentioned above, the image display apparatus is provided with a plurality of pumps as shown in JP Patent Publication (Kokai) No. 2007-190725, for example, and the plurality of pumps are driven at the same time by a single motor. They are driven together with the pump exclusive for solvent all the time.

SUMMARY OF THE INVENTION

As shown in Patent Document 1, in the conventional image display apparatus, the pump exclusive for solvent is mainly used for preventing increase in concentration of the ink by replenishing the ink container with the solvent and for cleaning the nozzle by the solvent.

However, the pump exclusive for solvent is operated only for approximately several minutes in order to clean the nozzle once in 30 minutes in order to prevent increase in concentration in the ink container. Therefore, though the solvent pump does not have to be operated all the time, a load from the pump exclusive for solvent is applied to the motor all the time and the motor should consume unnecessary electric power. Also, the pump exclusive for solvent is operating all the time, and though it is not actually used, there is a possibility that its life might end earlier, which would increase repair/replacement cost of the solvent pump. On the other hand, another motor exclusive for a pump exclusive for solvent might be provided, but it would lead to increase in size of the apparatus and raise the cost.

That is, in the image display apparatus, if the number of pumps operated by a single motor can be reduced without increasing the number of motors, it is extremely advantageous in terms of design and operation.

The present invention was made in view of the above circumstances and has an object to provide configuration of an image display apparatus that can reduce the number of pumps as much as possible.

In order to solve the above problem, an image display apparatus according to the present invention is provided with an ink chamber in an ink supply path from an ink container to a print head and a solvent chamber in a solvent supply path from a solvent container to the print head. The ink chamber and the solvent chamber are formed by dividing a liquid chamber by an elastic member (diaphragm) so that volumes (capacities) of the ink chamber and the solvent chamber are changed according to a pressure of the ink. In order to prevent backflow of the solvent from the solvent chamber to the solvent container, a check valve (may be an electromagnetic valve) is provided. Also, the apparatus is configured such that when ink is not supplied, a space of the solvent chamber is ensured by a repulsion force of a spring.

That is, the image display apparatus according to the present invention is an image display apparatus for recording a print on a target article and is provided with a print head having a nozzle for particulating and injecting ink, a charging electrode for charging ink into ink particles, a deflecting electrode for deflecting the charged ink particles, and a gutter for capturing the ink particles not used for print, a main body portion having an ink container for storing the ink, a supply pump for supplying the ink to the print head, a solvent container for storing a solvent, a collecting pump for supplying the solvent from the solvent container to the ink container and collecting the ink particles captured by the gutter in the ink container, an operation control portion, and a liquid chamber, and a motor for operating the supply pump and the collecting pump. Here, the liquid chamber has an ink chamber for temporarily storing the ink to be supplied to the print head and a solvent chamber for temporarily storing the solvent. Also, a supply path for supplying the ink from the main body portion to the print head, a solvent path for supplying the solvent from the main body portion to the print head, and a collecting path for returning the ink particles captured in the gutter to the ink container are constituted. The ink chamber is provided between the supply pump and the nozzle in the supply path, while the solvent chamber is provided between the solvent container and the nozzle in the solvent path. The liquid chamber is divided by a member for relatively changing volumes of the ink chamber and the solvent chamber by a pressure of the ink supplied to the print head.

Further features of the present invention will be made apparent from the best mode for carrying out the present invention and the attached drawings.

According to the present invention, it is no longer required to provide a motor exclusively for a pump exclusive for solvent, and size increase or cost rise can be solved. Also, a solvent pump for feeding from the solvent container to the nozzle is no longer required, which can reduce power consumption fed to the motor, prevent size increase of the apparatus and lower costs.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENT

Figure 1:
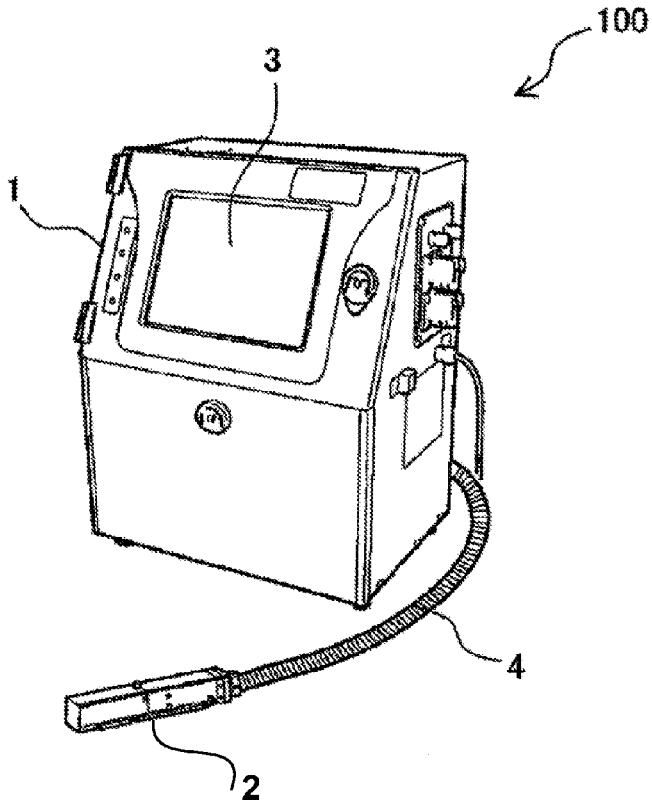
FIG. 1 is a perspective view illustrating an appearance of a main body and a print head of an image display apparatus.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications a fall within the ambit of the appended claims.

An embodiment of the present invention will be described below referring to the accompanying drawings. However, it should be noted that the present embodiment is merely an example for realizing the present invention and does not limit a technical scope of the present invention. Also, the same reference numerals are given to common configurations in each drawing.

<Appearance and Use State of the Apparatus>

FIG. 1 is a view illustrating an appearance configuration of the image display apparatus according to the embodiment of the present invention. An image display apparatus 100 is provided with a main body portion 1 having an apparatus display portion 3 and a print head 2, and the main body portion 1 and the print head 2 are connected to each other by a cable 4. Internal configurations of the main body portion 1 and the print head 2 will be described later. On the apparatus display portion 3, characters to be printed on a target article, ink state, apparatus operating state and the like, for example, are displayed.

Figure 2:
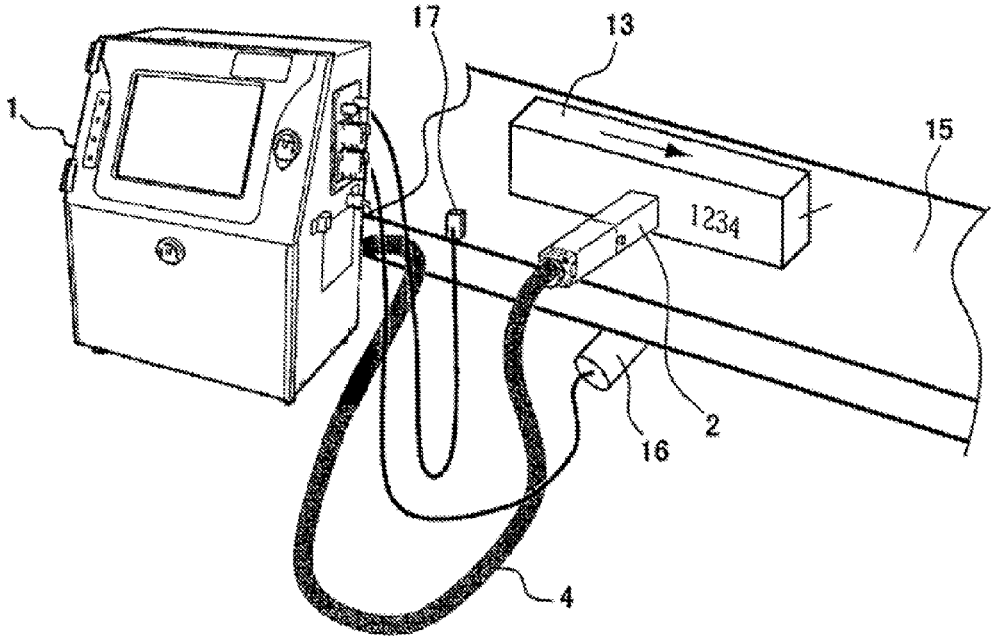
FIG. 2 is a perspective view illustrating a use state of the image display apparatus.

FIG. 2 is a view illustrating an example of an actual use state of the image display apparatus 100. The image display apparatus 100 is installed in a production line in a plant where foods and drinks are produced, for example. The main body portion 1 is installed at a position where a user can work, while the print head 2 is installed at a position in proximity to a print target 13 conveyed on a production line such as a belt conveyer 15.

On the production line such as the belt conveyer 15, an encoder 16 for outputting a signal according to a conveying speed to the image display apparatus for printing in the same width regardless of the conveying speed and a print sensor 17 for detecting the print target 13 and outputting a signal instructing print to the image display apparatus are installed, and each of them is connected to a control portion 49 (See FIG. 6) in the main body portion 1.

The control portion 49 controls a charged amount and charging timing to an ink particle 10 discharged from a nozzle according to the signals from the encoder 16 and the print sensor 17 so that while the print target 13 passes in the vicinity of the print head 2, the charged and deflected ink particle 10 (see FIG. 3) is made to adhere to the print target 13 for print.

Figure 3:
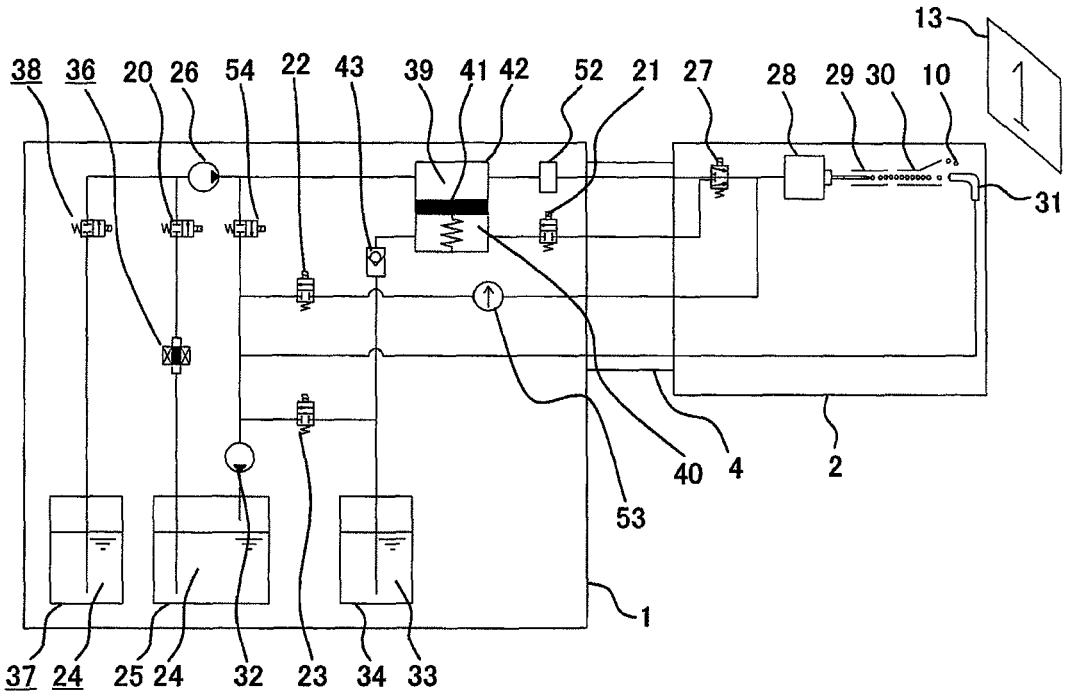
FIG. 3 is a diagram illustrating a path configuration of the image display apparatus according to the present invention.

As shown in FIG. 3, the main body portion 1 has an ink container 25, a viscosimeter 36, a first electromagnetic valve 20, a supply pump 26, a liquid chamber 42, and a regulator 52 as a path for supplying ink 24 to a nozzle 28, and they are connected in order. Also, the main body portion 1 has a sub container 37 and a fifth electromagnetic valve 38 as a path for feeding the new ink 24 to the ink container 25. The sub container 37 and the fifth electromagnetic valve 38 are connected between a first electromagnetic valve 20 and the supply pump 26.

Also, as a path for supplying a solvent 33 to the nozzle 28, a solvent container 34 and a second electromagnetic valve 21 are provided, and they are connected in order. The both paths are connected to a three-way switching electromagnetic valve 27 of the print head 2 through the cable 4. And the three-way switching electromagnetic valve 27 serves to feed one of the ink 24 and the solvent 33 to the nozzle 28.

During apparatus operation, the three-way switching electromagnetic valve 27 is in an excited state (non-excited state in the case of a valve in which an ink supply path side is opened in a non-excited state) so that the supply path side of the ink 24 is opened, and the ink 24 is supplied to the nozzle 28 and it is made into the ink particle 10 at the nozzle 28. The ink particle 10 is selectively charged by a charging electrode 29 on a rear stage, and the charged ink particle 10 receives a deflecting force in an electric field formed by a deflecting electrode 30 on a further rear stage so as to fly over a gutter 31 and reaches onto the print target 13.

On the other hand, the ink particle 10 not charged by the charging electrode 29 goes straight through the electric field formed by the deflecting electrode 30 and is captured by the gutter 31 and returned to the ink container 25 by a collecting pump 32. And to the path connecting the supply pump 26 and the liquid chamber 42, a path connecting to the collecting pump 32 is connected, and between a connection point of the path connecting the supply pump 26 and the liquid chamber 42 and a path in which the collecting pump 32 is arranged and the collecting pump 32, a depressurizing valve 54 is arranged.

During stop processing of the image display apparatus 100 (during nozzle cleaning), the three-way switching electromagnetic valve 27 is in the non-excited state (excited state in the case of a valve in which the ink supply path side is opened in the non-excited state) so that a supply path side of the solvent 33 is opened and the solvent 33 is supplied to the nozzle 28. Also, between the three-way switching electromagnetic valve 27 and the nozzle 28, a path for sucking a remaining liquid in the nozzle 28 at the nozzle cleaning and for circulating the ink 24 is connected. This path is connected to the collecting pump 32 through the cable 4 and in this path, a pressure sensor 53 and a third electromagnetic valve 22 are installed.

In order to replenish the ink container 25 with the ink 24, an ink replenishment path constituted by the sub container 37 and the fifth electromagnetic valve 38 in the main body portion 1 is connected to between the first electromagnetic valve 20 and the supply pump 26. By the supply pump 26, the ink 24 in the sub container 37 is supplied to the nozzle, is made to fly over the charging electrode 29 and the deflecting electrode 30 and captured by the gutter 31 and supplied by the collecting pump 32 to the ink container 25. At this time, the first electromagnetic valve 20 is in a non-excited and closed state. That is because the ink 24 is not pumped up from the ink container 25.

In order to prevent increase in concentration in the ink container 25 and to replenish the solvent, a solvent replenishment path is provided connecting the solvent container 34 and the ink container 25 in the main body portion 1, and a fourth electromagnetic valve 23 is installed in the path connecting the solvent container 34 and the ink container 25.

Also, in order to control concentration inside the ink container 25, the viscosimeter 36 is connected between the ink container 25 and the first electromagnetic valve 20. The viscosimeter 36 controls viscosity so that an optimal set value is set for print. That is, if it is determined that an ink concentration measured by the viscosimeter 36 becomes higher than a predetermined value, control is made so that the solvent 33 is supplied from the solvent container 34 so as to adjust the concentration of the ink.

Next, the liquid chamber 42 will be described in detail. As shown in FIG. 3, on the downstream side of the supply pump 26 in the main body portion 1 (the ink container side when seen from the electromagnetic valve, the pump and the like is defined as the upstream and the head side as the downstream), the liquid chamber 42 provided with an ink chamber 39 and a solvent chamber 40 is arranged. The ink chamber 39 is connected to the three-way switching electromagnetic valve 27 through the regulator 52 and the cable 4. Also, between the solvent container 34 and the second electromagnetic valve 21, the solvent chamber 40 is installed. The solvent chamber 40 is connected to the second electromagnetic valve 21, and between the solvent chamber 40 and the solvent container 34, a check valve (means for preventing solvent backflow and may be an electromagnetic valve) 43 is connected. The ink chamber 39 and the solvent chamber 40 are partitioned by a diaphragm 41 and configured so that liquid does not leak to each other.

Subsequently, a method of replenishing the solvent in order to prevent increase in concentration of the ink 24 in the ink container 25 will be described. During a printable state, since the first electromagnetic valve 20 and the three-way switching electromagnetic valve 27 are in the excited state, the ink supply side is opened, and the ink 24 is supplied to the nozzle 28. Thus, the other second electromagnetic valve 21, the third electromagnetic valve 22, and the fourth electromagnetic valve 23 are in the non-excited state and closed.

Also, at this time, the second electromagnetic valve 21 is in the non-excited state and closed. Moreover, by the check valve 43 connected to the upstream side of the liquid chamber 42, the solvent 33 on the downstream side from the check valve 43 does not flow out (backflow) to the upstream side.

The solvent is replenished during printing. Therefore, the first electromagnetic valve 20, the fourth electromagnetic valve 23, and the three-way switching electromagnetic valve 27 are in the excited state. The collecting pump 32 conducts sucking only from the gutter 31 during usual printing, but during the solvent replenishment, while the sucking from the gutter 31 is continued, the solvent is also sucked from the solvent container 34. In a path from the solvent container 34 through the fourth electromagnetic valve 23 to merge to a collecting path, an appropriate diaphragm is needed so that a solvent only to such a degree that ink collection from the gutter 31 is not obstructed flows during the solvent replenishment. In this way, during the solvent replenishment, the fourth electromagnetic valve 23 is opened, the solvent 33 in the solvent container 34 flows into the ink container 25 by the collecting pump 32 so that increase in concentration of the ink 24 in the ink container 25 can be prevented.

<Configuration and Status Change of Liquid Chamber>

Figure 4:
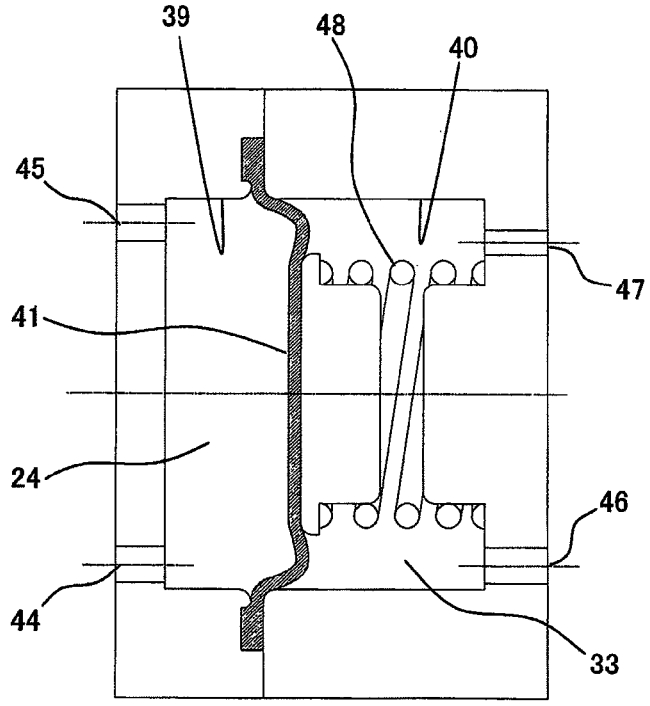
FIG. 4 is a sectional view illustrating a state of a liquid chamber during ink injection.

FIG. 4 is a diagram illustrating a section of the liquid chamber 42 in the printable state of the present invention.

The ink chamber 39 in the liquid chamber 42 is provided with an ink-in side port 44 and an ink-out side port 45 for flowing in/out of the ink 24.

On the other hand, the solvent chamber 40 of the liquid chamber 42 is provided with a solvent-in side port 46 and a solvent-out side port 47 for flowing in/out of the solvent 33.

In the solvent chamber 40, a spring 48 is provided at the diaphragm 41, and an elastic force of the spring 48 is set, in its movable range, smaller than a value obtained by multiplying a pressure of the ink when the ink is supplied to the ink chamber 39 by closing the ink supply side of the three-way switching electromagnetic valve 27 (maximum pressure that the supply pump can output) by a pressure-receiving area receiving the pressure of the diaphragm (the solvent in the solvent chamber can be pushed out when the ink chamber is pressurized at the maximum). As a component having an action to change the size of the ink chamber 39 and the solvent chamber 40 by the liquid pressure, the diaphragm 41 is used herein, but not limited to that, any alternative may be used as long as the similar action can be exerted.

While the ink is injected from the nozzle, the electromagnetic valve in the path for supplying the ink 24 is such that the first electromagnetic valve 20 is excited and opened, while in the path for supplying the solvent 33, the second electromagnetic valve 21 is in the non-excited state and closed. On the other hand, the third electromagnetic valve 22 and the fourth electromagnetic valve 23 are controlled in the non-excited state and closed. Also, the three-way switching electromagnetic valve 27 is controlled in the excited state, the supply path side of the ink 24 is opened, and the ink 24 is supplied and injected to the nozzle 28.

In this case, in the liquid chamber 42, the ink 24 flows from the ink-in side port 44 to the ink-out side port 45, while since the solvent 33 has the check valve on the upstream side of the solvent-in side port 46 and the second electromagnetic valve 21 on the downstream side of the solvent-out side port 47 is closed, there is no flow.

Figure 5:
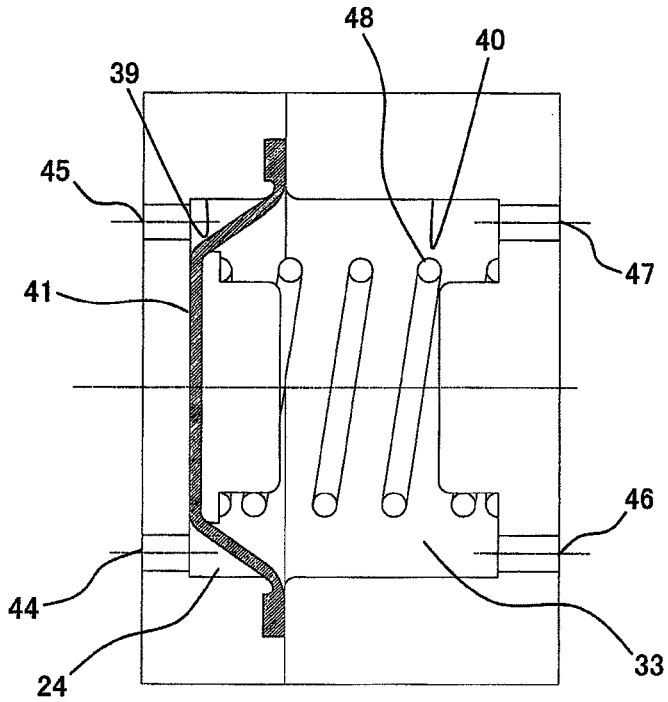
FIG. 5 is a sectional view illustrating a state of a liquid chamber before solvent injection.

When the image display apparatus 100 is stopped, the diaphragm 41 is in the state as shown in FIG. 5. On the other hand, at start-up processing of the image display apparatus 100, in order to clean the nozzle 28 and the like, the solvent in the solvent chamber 40 is injected. As a result, the volume in the solvent chamber 40 is reduced, and the diaphragm 41 is displaced to the solvent chamber 40 side as shown in FIG. 4.

When the image display apparatus 100 is to be stopped, it is necessary that, at the start-up of the image display apparatus 100, the volume of the solvent chamber 40 should be maximized in order to clean the nozzle 28 and the like by the solvent 40, the diaphragm 41 is displaced to the ink chamber 39 side as shown in FIG. 5.

In a preparation state before the solvent 33 is injected, the electromagnetic valves other than the three-way switching electromagnetic valve 27 are all in the non-excited state and closed. At this time, if a pressing force to the diaphragm 41 of the ink chamber 39 is lowered and the elastic force of the spring 48 pressing the diaphragm 41 overcomes the pressing force applied on the diaphragm 41 from the ink chamber 39, the diaphragm 41 is brought into a projecting state to the ink chamber 39 by the spring 48 so that the solvent 33 can be pumped up from the solvent container 34 and brought into the state shown in FIG. 5.

Also, at this time, since the three-way switching electromagnetic valve 27 is opened, the ink particle 10 is injected from the nozzle 28. However, if the ink pressure in the ink chamber 39 becomes too low, the ink 24 injected from the nozzle 28 departs from the gutter 31. In order to prevent such an event, a pressure in the ink chamber 39 is measured by the pressure sensor 53, and when the pressure sensor 53 detects that the pressure in the ink chamber 39 has reached a rated value, a detection signal is transmitted to the control portion 49 in the main body. The control portion 49 excites and opens the first electromagnetic valve 20 and the second electromagnetic valve 21, brings the three-way switching electromagnetic valve 27 into the non-excited state at the same time, and controls such that the solvent path side is opened. At this time, since the three-way switching electromagnetic valve 27 has the solvent path side in the open state and moreover, the first electromagnetic valve 20 is opened, the inside of the ink chamber 39 is pressurized. On the other hand, the solvent 33 in the solvent chamber 40 does not flow (backflow) into the solvent container 34 owing to the check valve 43 on the solvent-in side port 46 but flows into the nozzle 28 and has the solvent injected so that the nozzle 28 is cleaned. After the nozzle cleaning, the liquid remaining in the nozzle 28 and the like is sucked and collected since all the electromagnetic valves other than the third electromagnetic valve 22 are closed. If the apparatus is in the stop state in this way, since the pressure in the path is drained, the liquid chamber is brought into the state shown in FIG. 5.

Figure 6:
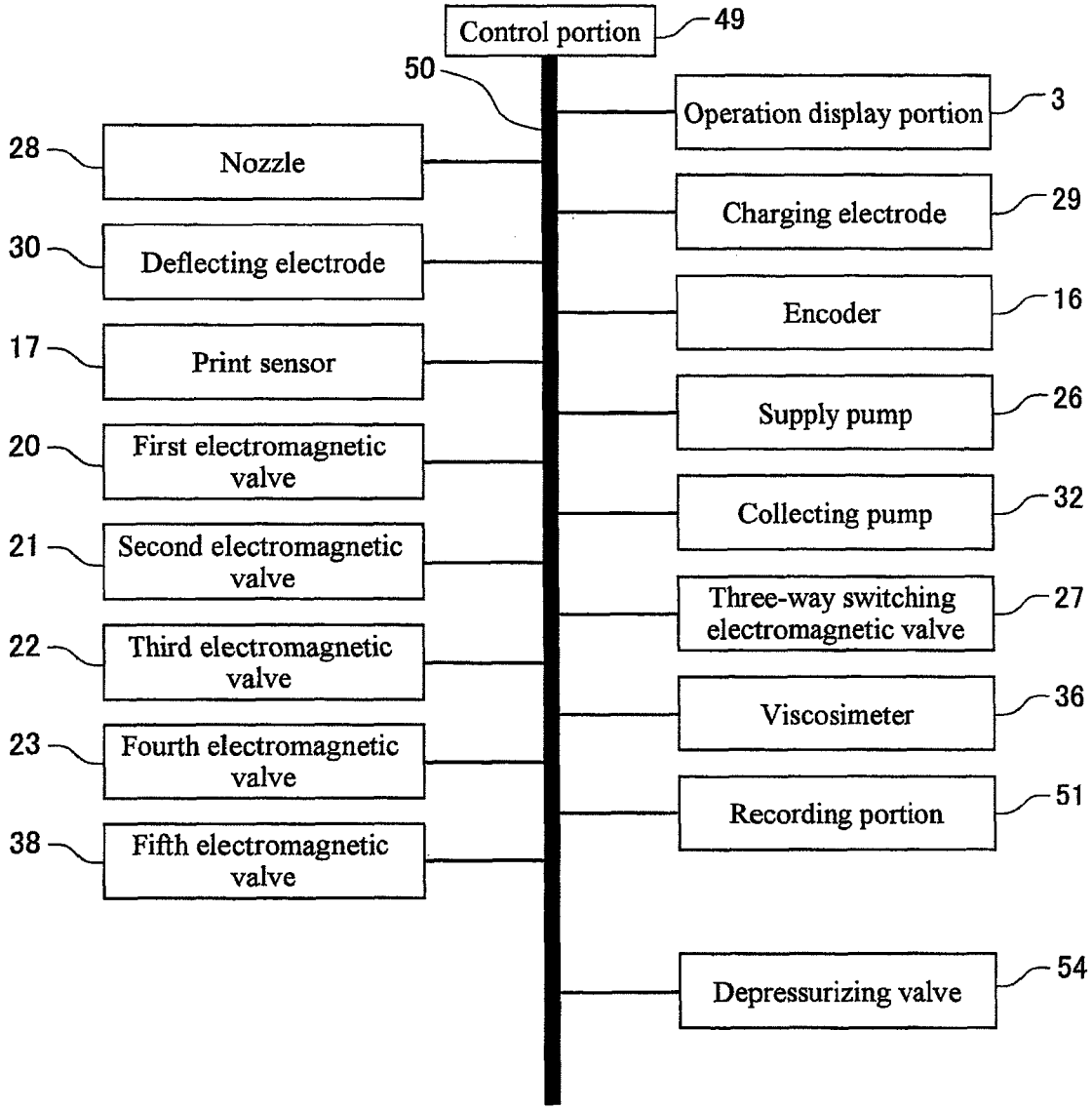
FIG. 6 is a functional block diagram of the image display apparatus according to the present invention.

Next, an operation of the liquid chamber 100 will be described in terms of a relation with an operation of each portion in the image display apparatus 100. FIG. 6 is a block diagram illustrating functional configuration of the image display apparatus 100 according to an embodiment of the present invention.

The image display apparatus 100 is provided with the control portion 49 configured by an MPU and the like, for example. The control portion 49 controls each portion of the nozzle 28, the deflecting electrode 30, the print sensor 17, the first electromagnetic valve 20, the second electromagnetic valve 21, the third electromagnetic valve 22, the fourth electromagnetic valve 23, the fifth electromagnetic valve 38, the operation display portion 3, the charging electrode 29, the encoder 16, the supply pump 26, the collecting pump 32, the viscosimeter 36, the three-way switching electromagnetic valve 27, and a recording portion (memory) 51 and the like through a bus line 50.

In the recording portion 51, a program for controlling each portion of the image display apparatus 100 is stored. The control portion 49 controls the operation of each portion constituting the image display apparatus 100 on the basis of the program.

When a user carries out stop processing of the image display apparatus 100, the control portion 49 first turns off the first to fourth electromagnetic valves 20 to 23 in order to increase the volume of the solvent chamber 40 and then, turns on the three-way switching electromagnetic valve 27. If each electromagnetic valve is controlled in this way, the pressure in the ink chamber 39 is lowered. At this time, the control portion 49 determines if the pressure in the ink chamber 39 has reached a rated value or not using the pressure sensor 53. If the control portion 49 determines that the pressure in the ink chamber 39 has reached the rated value, the volume of the solvent chamber 40 is considered to become the maximum, and an operation is changed to that of a solvent injection state.

The control portion 49 turns on the first electromagnetic valve 20 and the second electromagnetic valve 21 in order to carry out the solvent injection processing, and turns off the third electromagnetic valve, the fourth electromagnetic valve 23, and the three-way switching electromagnetic valve 27. That is, the control portion 49 excites and opens the first electromagnetic valve 20, brings the three-way switching electromagnetic valve 27 into the non-excited sate and opens the solvent path. Then, since the supply path side is pressurized by the supply pump 26, with increase in the volume of the ink chamber 39 in the liquid chamber 42, the diaphragm 41 is displaced to the solvent chamber 40 side, the solvent 33 in the solvent chamber 40 is pushed out to the nozzle 28, and the solvent 33 is injected from the nozzle 28.

Subsequently, the control portion 49 executes the suction processing in the nozzle and paths. In this case, only the third electromagnetic valve 22 is turned on, while the other electromagnetic valves are off. And the image display apparatus 100 is controlled to the stop state.

After that, by opening the depressurizing valve 54, a depressurizing processing in which a remaining pressure in the path connecting the collecting pump 26 and the electromagnetic valve 27 is extracted into the ink container 25 through the collecting pump 32 is carried out, and the remaining pressure in the ink chamber 39 is reduced so that the spring 48 in the solvent chamber 40 overcomes the pressure from the ink chamber 39, the diaphragm 41 is gradually displaced to the ink chamber 39 side, and the liquid chamber 42 is brought into a state as shown in FIG. 5. And in the course during which the diaphragm 41 is displaced to the ink chamber 39 side, the solvent 33 is sucked out of the solvent container 34. As a result, the solvent chamber 40 is filled with the solvent 33.

As mentioned above, there is no need to provide an exclusive motor for a pump exclusive for solvent, size or cost is not increased, a solvent pump for feeding a solvent from the solvent container to the nozzle is no longer needed, power consumption to be fed to the motor can be reduced, the size of the apparatus is not increased, and the cost can be reduced.

Alternatively, an electromagnetic valve instead of the check valve may be provided between the liquid chamber 42 and the solvent container 34. Alternatively, the check valve may be integrated with the solvent-in side port 46 of the liquid chamber 42.

<Conclusion>

In this embodiment, the ink chamber is provided between the supply pump and the nozzle, and the check valve and the three-way switching electromagnetic valve between the second electromagnetic valve and the print head are connected in order from the solvent container to the print head. Also, the solvent chamber is provided between the check valve and the second electromagnetic valve, an elastic material is sandwiched between the ink chamber and the solvent chamber so that the solvent chamber side is projected, and moreover, the spring is provided in the solvent chamber and installed perpendicular to the elastic material. The ink-in side port of the ink chamber is connected to the supply pump, while the ink-out side port is connected to the nozzle. Also, the solvent-in side port in the solvent chamber is connected to the check valve, while the solvent-out side port is connected to the second electromagnetic valve.

During the printable state, the ink flows through the ink chamber, and since the path ahead of the solvent-in side port and the solvent-out side port of the solvent chamber is closed by the check valve and the second electromagnetic valve, the volumes in the ink chamber and the solvent chamber are hardly changed.

However, as a stage prior to solvent injection, by closing the first electromagnetic valve located between the ink container and the supply pump, the pressure in the ink chamber is lowered, and with that, the spring in the solvent chamber is extended. Also, since the valve connected to the solvent-in side port serves as the check valve and sucks the solvent from the solvent container, the volume of the solvent chamber is increased, and the elastic material projects toward the ink chamber. At the same time when the pressure in the ink chamber drops below a rated pressure, a signal is sent to the control portion of the apparatus so as to pressurize the ink chamber again, and the elastic material is brought into a downward projecting state to the ink chamber so that the solvent flows into the nozzle.

As being configured as above, a solvent pump for supplying solvent, driven by a motor, can be reduced, a power consumption to be fed to the motor can be reduced, the size of the apparatus is not increased, and a cost can be reduced. Also, since the solvent supply is realized without using a motor, there is no need to use a motor exclusive for solvent supply, the scale of the apparatus can be made small and an image display apparatus contributing to cost reduction can be provided.

The present invention can be also realized by a program code of software that realizes functions of the embodiment. In this case, a recording medium recording the program code is provided for the system or the apparatus, and a computer (or CPU or MPU) of the system or the apparatus reads out the program code stored in the recording medium. In this case, the program code itself read out of the recording medium realizes the above-mentioned functions of the embodiment, and the program code itself and the recording medium storing it constitute the present invention. Recording mediums for supplying such a program code include, for example, floppy (registered trademark) disk, CD-ROM, DVD-ROM, hard disk, optical disk, magneto-optic disk, CD-R, magnetic tape, non-volatile memory card, ROM and the like.

Also, it may be so configured that on the basis of an instruction of the program code, OS (operating system) running on the computer executes a part of or the whole of the actual processing so that the functions of the above-mentioned embodiment are realized by the processing. Moreover, it may be so configured that after the program code read out of the recording medium is written in a memory of the computer, on the basis of the instruction of the program code, the CPU of the computer and the like executes a part of or the whole of the actual processing so that the functions of the above-mentioned embodiment are realized by the processing.

Also, it may be so configured that the program code of the software that realizes the functions of the above-mentioned embodiment is delivered through a network and stored in storage means such as a hard disk, memory or the like in the system or the apparatus or in a recording medium such as a CD-RW, CD-R or the like so that the program code stored in the storage means or recording medium is read out and executed by the computer (or CPU or MPU) of the system or the apparatus at use.

What is claimed is:

1. An image forming apparatus for recording a print on a target article, comprising:

a print head having a nozzle which injects ink in a particle state, a charging electrode which charges said ink into the ink particle, a deflecting electrode which deflects the charged ink particle, and a gutter which captures the ink particle not used for printing;

a main body portion having an ink container which stores said ink, a supply pump which supplies said ink to said print head, a solvent container which stores a solvent, a collecting pump which supplies said solvent from said solvent container to said ink container and collects the ink particle captured by said gutter in said ink container, an operation control portion, and a liquid chamber; and a motor which operates said supply pump and said collecting pump;

wherein said liquid chamber has an ink chamber which temporarily stores ink to be supplied to said print head and a solvent chamber which temporarily stores said solvent and is constituted by a supply path which supplies said ink from said main body portion to said print head, a solvent path which supplies said solvent from said main body portion to said print head, and a collecting path which returns said ink particle captured by said gutter to said ink container, said ink chamber being provided between said supply pump in said supply path and said nozzle, said solvent chamber being provided between said solvent container in said solvent path and said nozzle, and said liquid chamber being divided by a member which relatively changes volumes of said ink chamber and said solvent chamber by a pressure of the ink supplied to said print head, said member is configured to be displaced responsive to an increase of the pressure of the ink so that the ink can be supplied to said nozzle, the supply of the ink and the solvent to the nozzle is configured to be switched over by transition of the member; and wherein said member is in a state where a diaphragm member is displaced at a position closest to the side of said ink chamber when a printing operation is stopped.

2. The image forming apparatus according to claim 1, wherein said liquid chamber has an ink-in side port on said supply pump side of said ink chamber, an ink-out side port on said nozzle side, a solvent-in side port on said solvent container side of said solvent chamber, and a solvent-out side port on said nozzle side.

3. The image forming apparatus according to claim 2, wherein said liquid chamber is divided by a diaphragm so as to form said ink chamber and said solvent chamber.

4. The image forming apparatus according to claim 2, wherein a check valve is provided between said solvent-in side port and said solvent container in said solvent path.

5. The image forming apparatus according to claim 2, wherein an electromagnetic valve is provided between said solvent-in side port and said solvent container in said solvent path.

6. The image forming apparatus according to claim 2, wherein a check valve or said electromagnetic valve is provided integrally at said solvent-in side port.

7. The image forming apparatus according to claim 1, wherein said operation control portion controls opening/closing of a valve provided at said supply path and said solvent path in a printable state so that ink supply to said ink chamber is enabled and solvent supply to said solvent chamber is stopped and controls opening/closing of the valve provided at said supply path and said solvent path in a solvent injectable state so that the ink supply to said ink chamber is stopped and the solvent supply to said solvent chamber is enabled.

8. The image forming apparatus according to claim 7, wherein said operation control portion determines if it is in said solvent injectable state or not based on whether the pressure inside said ink chamber is not more than a predetermined value or not.

* * * * *